US007748568B2

(12) United States Patent
Lasserre et al.

(10) Patent No.: US 7,748,568 B2
(45) Date of Patent: Jul. 6, 2010

(54) PACKAGING AND DISPENSING ASSEMBLY

(75) Inventors: Pierre-Andre Lasserre, Coubron (FR); Marcel Sanchez, Paris (FR); Philippe Briand, Creteil (FR)

(73) Assignee: L'Oreal, Paris (FR)

( * ) Notice: Subject to any disclaimer, the term of this patent is extended or adjusted under 35 U.S.C. 154(b) by 800 days.

(21) Appl. No.: 11/509,581

(22) Filed: Aug. 25, 2006

(65) Prior Publication Data

US 2007/0045344 A1 Mar. 1, 2007

Related U.S. Application Data

(60) Provisional application No. 60/713,371, filed on Sep. 2, 2005.

(30) Foreign Application Priority Data

Aug. 25, 2005 (FR) ..... 05 52566

(51) Int. Cl.
*B67D 7/70* (2010.01)

(52) U.S. Cl. ..... 222/135; 222/402.11; 222/402.21

(58) Field of Classification Search ..... 222/135, 222/136, 137, 138, 145.1, 153.11, 153.14, 222/182, 402.11, 402.13, 402.21, 402.22, 222/402.23

See application file for complete search history.

(56) References Cited

U.S. PATENT DOCUMENTS

| | | | | |
|---|---|---|---|---|
| 2,703,665 | A * | 3/1955 | Soffer et al. | 222/402.11 |
| 2,707,968 | A * | 5/1955 | Efford | 137/382 |
| 3,559,890 | A * | 2/1971 | Brooks et al. | 239/304 |
| 3,610,479 | A | 10/1971 | Venus, Jr. et al. | |
| 3,618,827 | A * | 11/1971 | Melocchi | 222/162 |
| 3,765,573 | A * | 10/1973 | Landsman | 222/182 |
| 3,768,707 | A | 10/1973 | Nigro | |
| 3,931,912 | A * | 1/1976 | Hsiung | 222/94 |
| 3,967,760 | A | 7/1976 | Marcon | |
| 5,167,347 | A * | 12/1992 | Wiegner et al. | 222/94 |
| 5,762,322 | A | 6/1998 | Smith | |
| 2002/0117516 | A1 * | 8/2002 | Lasserre et al. | 222/145.5 |

FOREIGN PATENT DOCUMENTS

| | | |
|---|---|---|
| FR | 2 732 245 | 10/1996 |
| FR | 2 814 727 | 4/2002 |
| JP | 2004-154459 | 6/2004 |

OTHER PUBLICATIONS

U.S. Appl. No. 11/509,560, filed Aug. 25, 2006, Lasserre et al.

* cited by examiner

*Primary Examiner*—Kevin P Shaver
*Assistant Examiner*—Daniel R Shearer
(74) *Attorney, Agent, or Firm*—Oblon, Spivak, McClelland, Maier & Neustadt, L.L.P.

(57) ABSTRACT

An assembly for packaging and a dispensing a product includes at least one container containing a product, with the container including an actuation rod. A dispensing device is provided which can actuate the actuation rod in order to dispense the product through a dispensing aperture. Advantageously, the dispensing device is positionable in at least two different positions, including: (1) a use position in which the actuation device can rock or tilt the actuation rod to dispense the product, but in which the dispensing device does not move the actuation rod along its longitudinal axis, and (2) an intermediate position in which the dispensing device is not in fluid communication with the actuation rod. The arrangement can advantageously avoid dispensing of the product or products when such dispensing is not desired.

35 Claims, 3 Drawing Sheets

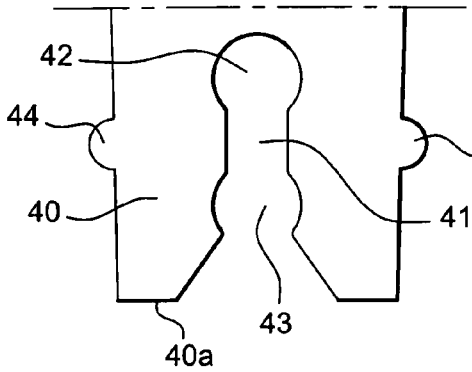
Fig. 5
Fig. 6
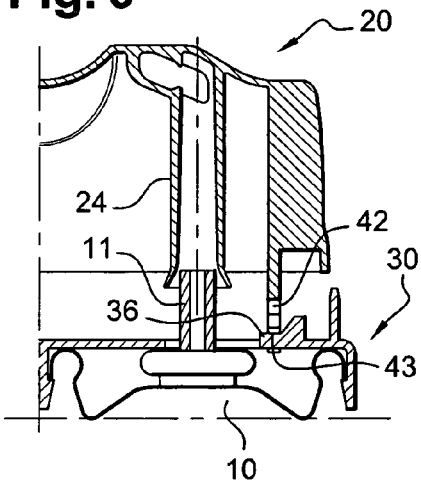
Fig. 7
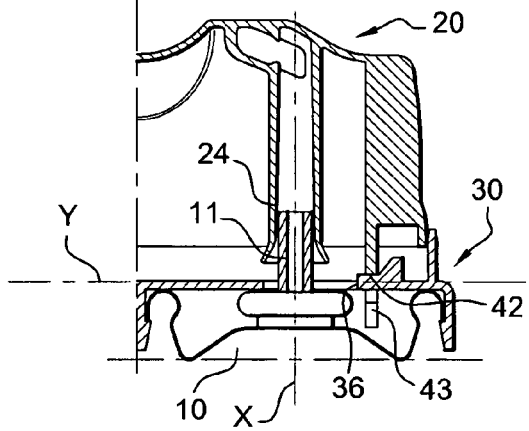
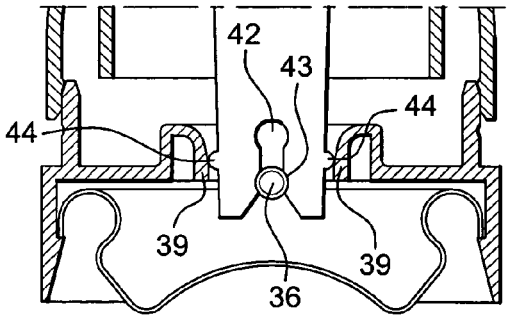
Fig. 8
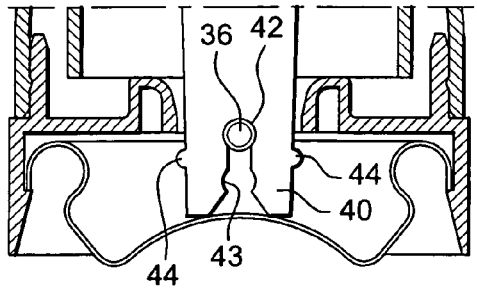
Fig. 9

PACKAGING AND DISPENSING ASSEMBLY

CROSS-REFERENCE TO RELATED APPLICATIONS

This document claims priority to French Application Number 05 52566, filed Aug. 25, 2005 and U.S. Provisional Application No. 60/713,371, filed Sep. 2, 2005, the entire content of which are hereby incorporated by reference.

FIELD OF THE INVENTION

The present invention concerns an assembly for packaging and dispensing a product, and is particularly advantageous for packaging and dispensing a cosmetic product. Such a product can be dispensed, for example, in the form of a cream, gel, foam or spray.

BACKGROUND OF THE INVENTION

Discussion of Background

A cosmetic product means a product as defined in Council Directive 93/35/EEC of 14 Jun. 1993, amending Directive 76/768/EEC for the sixth time.

Generally, a packaging and dispensing assembly, as can be utilized in the present invention, includes a container containing the product to be dispensed, with the container equipped with a dispensing member. Such a dispensing member can be, for example, a pump or a valve which is topped by a dispensing device. The dispensing device allows the user to convey the product coming out of the container to a dispensing aperture. It can also make it possible to control the actuation of the dispensing member, in order to eject a measure of product out of the container.

Certain dispensing devices can also be provided to allow the separate or mixed dispensing of two products stored separately in two containers.

French patent application FR-A-2 732 245 discloses a dispensing device that includes a body and a pushbutton. The pushbutton is movable with respect to the body to cause the simultaneous or separate dispensing of two products from two containers in which these products are stored separately. Each container is provided with a valve which includes a hollow actuation rod. Pushing upon the rod causes the dispensing of the product.

As is the case with the device described in the document FR-A-2 732 245, the devices for dispensing one or more products are generally fitted on the actuation rod or rods of the valve or of the pump. As a result, during assembly of the dispensing device on the container or containers, the actuation rod can be pushed in and therefore actuated. The product can then come out of the container at an undesired time.

JP2004-154459 describes an assembly of the same type as those described previously in which the pushbutton is attached to a collar which is itself fixed to the containers. The pushbutton is attached to the collar, in a single position, so as to be able to pivot relative to the collar and the containers in order to actuate the valves. The pushbutton includes two circular apertures, one on each side, with each aperture receiving a bulge provided on each side of the collar so as to allow the rocking of the pushbutton on the collar. The pushbutton is not fixedly mounted so that it can be easily separated from the containers and remounted thereon.

There is a need to have an assembly that is easy to produce and assemble.

There is also a need to have a dispensing assembly that includes a dispensing device that can be cleaned easily.

There is also a need to have an assembly that limits accidental dispensing of the products.

There is also a need to have a dispensing assembly that can be actuated easily.

There is also a need to have a dispensing assembly that can dispense two products coming from two containers, for example, in the same proportions at each actuation.

SUMMARY OF THE INVENTION

The above objects can be achieved by an assembly for packaging and dispensing a product according to the invention. According to a preferred example, the assembly includes at least one container containing a product, with the container being provided with a dispensing member that includes an actuation rod. A dispensing device is also provided, at least part of which is capable of moving with respect to the container in order to actuate the dispensing member and allow output of the product through at least one dispensing aperture. The dispensing device is configured to be mounted on the container in at least two different positions: (1) a position for use or a dispensing position in which the dispensing device is capable of making the actuation rod rock about a rocking axis in order to dispense the product and preferably in which it cannot move the actuation rod along its longitudinal axis; and (2) an intermediate position in which the dispensing device is not in fluidic communication with the actuation rod.

According to a preferred example, because the dispensing device is not able to move the actuation rod along its longitudinal axis in the use or dispensing position, the risks of unintentional actuation of the actuation rod are limited or reduced. In particular, the risk of the actuation rod being pushed in along its longitudinal axis is avoided during assembly of the device on the container during which the dispensing device is placed on the container with a movement along the longitudinal axis of the actuation rod. In addition, the dispensing device can be fixed in a removable manner on the container so that, for example, the user can remove it to clean it as needed between uses and replace it on the container without risk of undesired dispensing of the product.

Moreover, because the dispensing device is able to take an intermediate position in which it is not in fluidic communication with the actuation rod, the risk of actuating the actuation rod during assembly of the dispensing device on the container on assembly lines, and therefore the risk of leakage of product, are also limited or reduced.

The reference to the dispensing device not being in fluidic communication with the actuation rod means that there is no sealed connection between the two parts and that product cannot be transferred from the actuation rod to the dispensing device without there being a leak. In other words, the normal or designed communication route is not established By way of example, the dispensing device can be configured to be changed from the intermediate position to the position of use with a movement parallel to the longitudinal axis of the actuation rod. The dispensing device can thus easily be changed or moved from the intermediate position to the position of use since the user only needs to move the dispensing device in a translational movement, by pushing it in longitudinally.

Furthermore, as the actuation rod is actuated by rocking, it can be actuated with a small pressing force, which provides convenience or ease of use. The product can come out of the actuation rod with small or minimal rocking.

The dispensing device can include at least one tab that cooperates with at least one spindle so as to be able to pivot about the spindle and allow the rocking of the dispensing device in the use position.

Also by way of example, the dispensing device can include two tabs that cooperate respectively with two spindles, with the two tabs and the two spindles being respectively aligned along a line parallel to the rocking axis of the dispensing device. Each tab can include an opening that opens out at its lower end. The tab can thus easily straddle the corresponding spindle in an axial movement. The opening in the tab can include a narrow portion so as to form two notches at two different heights, with each notch being able to receive the corresponding spindle in each position of the dispensing device. Each notch can have a concave shape, for example, in order to delimit stable positions for the corresponding spindle. The opening in each tab can also widen out towards the lower end of the tab to facilitate its mounting on the corresponding spindle. Also by way of example, each tab can include at least one protuberance capable of coming into contact with a holding wall in the intermediate position so as to hold the dispensing device laterally. The holding wall can rest elastically on the protuberance in the intermediate position in order to limit the movements of the dispensing device.

The dispensing device can be mounted on the container via a fixing member that can include a mounting skirt capable of latching on the container, either directly on it, or on a clamp itself fixed, for example by crimping, on the neck of the container.

The assembly can also include two containers. By way of example, with such an arrangement, the dispensing device can be arranged to separately channel the products to two dispensing apertures. According to this embodiment or example, the dispensing device can include two distinct channels for conveying the product coming from each container to each dispensing aperture. This embodiment is particularly advantageous for dispensing products that are not stable over time when they are in contact with one another and should or must be brought into contact with one another as late as possible or in which it is desired to bring the products together close to the time of use.

Alternatively, the dispensing device can be arranged to allow mixing of the products before the products reach the dispensing aperture.

The assembly can also include a cap intended to protect the dispensing device.

By way of example, the container or containers can be pressurized. The dispensing member can then be a valve.

The assembly can be particularly advantageous with, for example, the container or containers containing a cosmetic product, in particular a hair coloring product. One of the containers can contain a coloring product and the other container an oxidizing product, for example.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as examples and in no way limit the invention.

FIG. 5 is a partial view of the dispensing device depicted in FIG. 4; and FIGS. 6 to 9 illustrate a cross-section the packaging and dispensing assembly, with the dispensing device being in the intermediate position in FIGS. 6 and 8 and in the position of use in FIGS. 7 and 9.

DETAILED DESCRIPTION OF THE PREFERRED EMBODIMENTS

Figure 1:
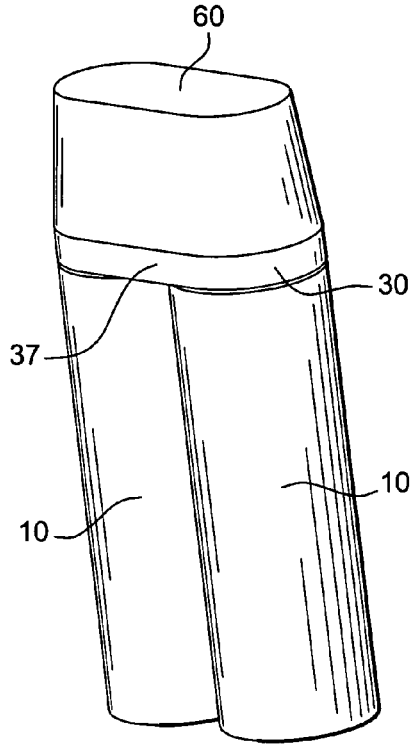
FIG. 1 is a perspective view of a packaging and dispensing assembly according to the invention.

Referring now to the drawings, like reference numerals are utilized to designate identical or corresponding parts throughout the several views.

Figure 2:
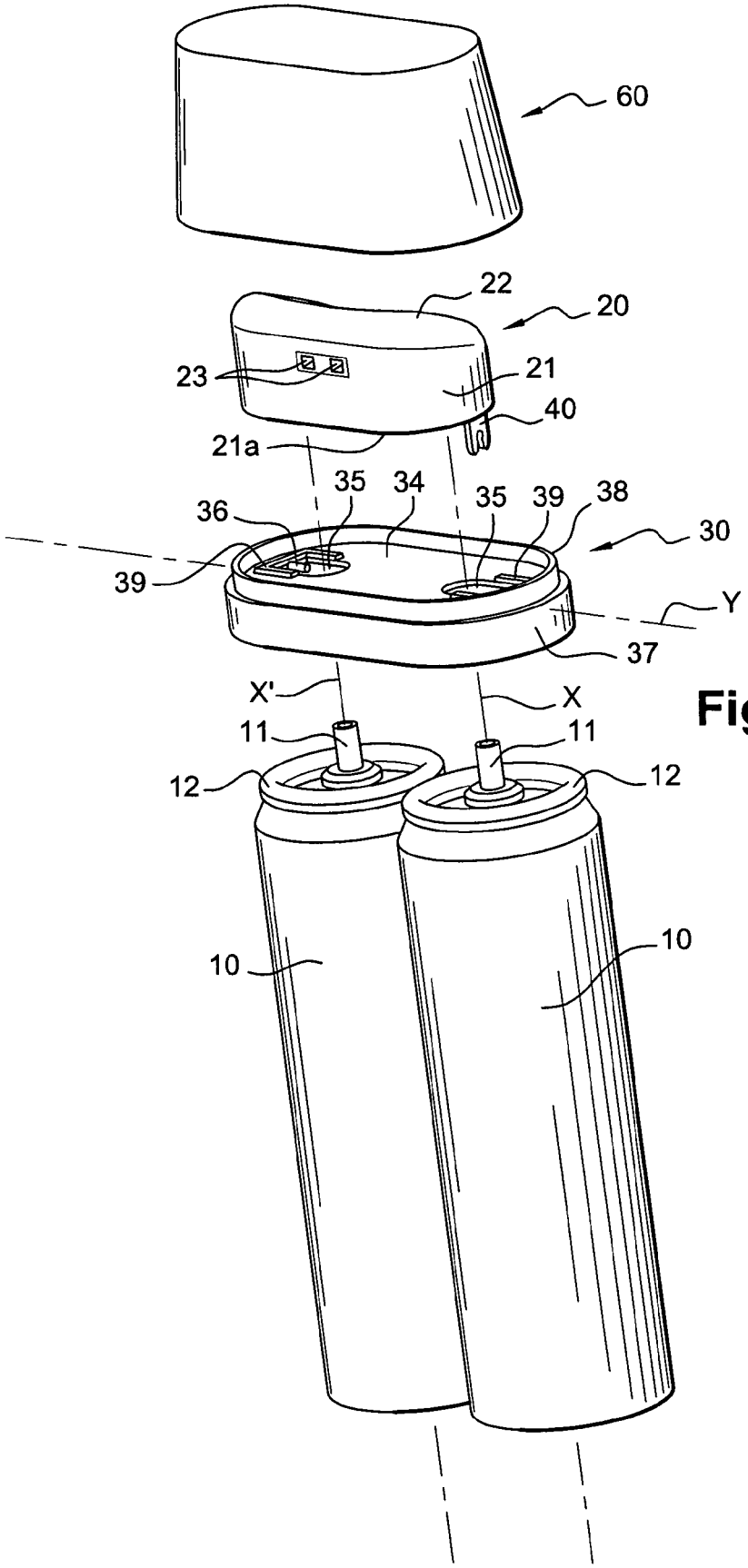
FIG. 2 is an exploded view of the assembly of FIG. 1.

FIGS. 1 and 2 illustrate an example of a dispensing assembly which includes a dispensing device 20 mounted on two containers 10 containing products to be mixed extemporaneously.

In this example, the containers contain cosmetic products, in particular, according to one particular example, hair coloring products. One of the containers 10 contains for example a coloring product and the other container 10 contains an oxidizing product.

Each container 10 is, in the example embodiment described, of the pressurized aerosol type and includes a valve provided with an actuation rod 11. One of the valves has a longitudinal axis X and the other valve has a longitudinal axis X' as can be seen in FIG. 2. The valve is held by crimping on a clamp 12, crimped on the neck of the container in the illustrated example.

The actuation rod 11 is hollow and dispensing of the product takes place when the actuation rod is rocked.

In the illustrated example, the dispensing device 20 is fixed on the containers by a fixing member 30. The dispensing device 20 is fixed so that it can make the actuation rods 11 rock in order to control the actuation of the valves.

By way of example, the fixing member 30 includes two tubular mounting skirts 31 of circular cross-section, which attach by latching under the clamp or flange 12 of the corresponding container. To that end, an annular flange 33 is provided on the radially inner surface of each skirt in order to lodge under each clamp or flange.

The two mounting skirts 31 are preferably placed next to one another so as to bring the containers as close together as possible and limit the size of the packaging assembly.

In the example shown, the mounting skirts 31 are also fixed or connected to one another by a transverse wall 34 that extends above each skirt 31. The transverse wall 34 has two passages 35 passing through it, respectively formed inside each mounting skirt 31, with each of the passages 35 being provided to receive the upper end of one of the containers 10. The two passages 35 are aligned along an axis Y.

Figure 3:
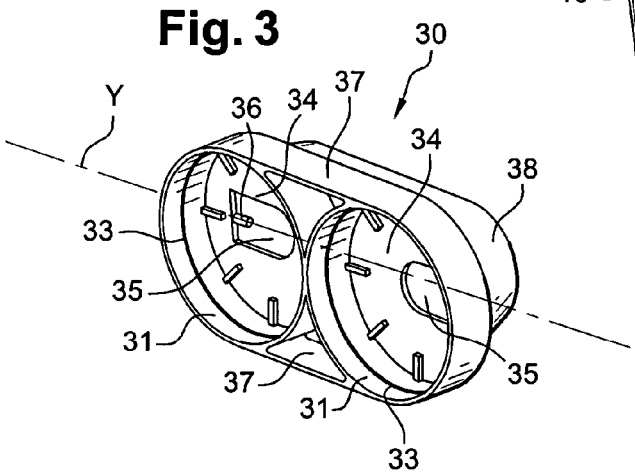
FIG. 3 is a bottom view of the fixing member of the packaging and dispensing assembly according to the invention.

In the example as shown in FIGS. 2 and 3, on the outer edge of each passage 35 there is provided a spindle 36, the function of which will be explained later in the description. The spindle 36 is substantially elongated along the axis Y and includes a circular cross-section at this axis Y.

The two skirts 31 are also connected together at their periphery by two straight walls 37, parallel to the axis Y so as to form an oval outer wall. Above the transverse wall 34, a peripheral rim 38 extends at the periphery of the wall 34.

The dispensing device 20 includes an outer shell 21, the upper part of which is rounded and forms an actuation surface 22. The shell 21 ends at its lower part with a free edge 21*a*.

Figure 4:
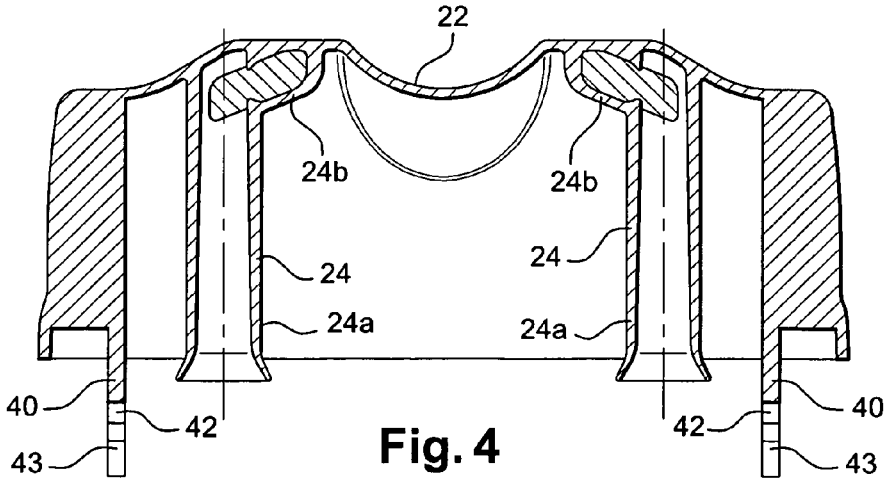
FIG. 4 is in isolation and schematically, in axial cross-section, the dispensing device of the assembly of FIG. 1.

The dispensing device 20 is arranged, according to the example illustrated, to separately channel the products coming from the containers to two dispensing apertures 23. To that end, two distinct ducts 24 are provided inside the shell 21 which each include a vertical end piece 24*a* (see, e.g., FIG. 4) intended to fit in a manner impervious to the product on the actuation rods. Each end piece is extended by an oblique portion 24*b* that opens out through a dispensing aperture 23. The two oblique portions 24*b* converge towards one another so that the two dispensing apertures 23 are substantially next to one another. The ends of the duct portions 24*b* preferably pass through the shell 21 so that the apertures 23 substantially extend beyond the outer casing of the shell.

According to a variant, not illustrated, the two ducts 24 are connected together before (or upstream of) their end so as to allow mixing of the products before the latter reach the dispensing aperture. With this arrangement, one outlet aperture can be provided.

The dispensing device 20 is arranged so that it can be mounted on the containers 10, via the fixing member 30, in two different positions.

The dispensing device 20 can take a use position, illustrated in FIGS. 7 and 9, in which it can actuate the actuation rods 11 in order to dispense the product. In this position of use, the dispensing device 20 can make the actuation rods rock about the rocking axis Y. In this position, the dispensing device is fitted on the actuation rods so as to be in fluidic communication with the rods.

In the position of use, the dispensing device 20 is mounted so that it cannot push in the actuation rods 11 along their longitudinal axis so as to avoid as much as possible or reduce the risk of actuating the valve rods at the time the dispensing device is put in place or mounted on the containers or, for example when the user repositions the dispensing device on the containers (for example if the user removes the device for cleaning).

The dispensing device 20 can also be positioned in an intermediate position, illustrated in FIGS. 6 and 8, in which it is not fitted on the actuation rods so as not to be in fluidic communication with the rods. The dispensing device 20 is then substantially at an axial distance from the actuation rods so that it is not fitted in a sealed manner on the actuation rods. The risk of actuating the actuation rods at the time the dispensing device is put in place on the containers is limited even more.

In order to be able to place the dispensing device 20 in these two positions, the dispensing device in the illustrated example includes two tabs 40 provided in proximity to each rounded end of the shell 21. Each tab is provided to be fixed on each spindle 36 situated on a side of each of the openings 35. The two tabs 40 are aligned along the axis Y to form a rocking axis.

As can be seen more particularly in FIG. 5, each tab 40 is substantially flat in this example, and includes a lower end 40*a* open so as to form a fork. The opening provided in the tab has an elongated shape along the main axis of the tab, with a narrow portion 41 approximately at mid-height of the opening, so as to form two notches 42 and 43 at two different heights. Each notch 42 and 43 has a substantially concave shape so as to receive the spindle 36 corresponding to the tab.

The opening formed in the tab also widens out in its lower portion in the direction of the lower end 40*a* of the tab to facilitate placement on the spindle 36.

In the position of use, the spindle 36 is situated in the higher notch 42. The spindle 36 is then axially stopped against the upper portion of the tab which prevents any movement of the dispensing device parallel to the longitudinal axis of the actuation rods. The tab can on the other hand rock about the spindle 36.

The tabs 40 and the spindles 36 are situated on either side of the actuation rods and, in particular, at the same distance from each rod in this example. They thus make it possible, in the position of use, to prevent the pushing in of each valve rod, and in particular of both valve rods at the same time in the illustrated example.

In the intermediate position, the spindle 36 is situated in the lower notch 43. In this position, the dispensing device is raised with respect to the actuation rods and the end pieces are not completely fitted on the rods.

In order to avoid wobbling of the dispensing device 20 relative to the fixing member 30 in the intermediate position, protuberances 44 are advantageously provided on the outer section of each tab 40. Each protuberance cooperates with a holding wall or holding portion 39 provided on the fixing member 30.

In the illustrated example, the protuberances 44 are formed on either side of the opening 41 of a tab, at the same height on the tab.

By way of example, each holding wall 39 partially surrounds the passage 35, in particular on the side of the spindle 36 on which the tab is mounted.

Each protuberance 44 thus comes into contact with the holding wall 39 provided on the fixing member 30 which then holds the tab tightly, in the intermediate position, thus avoiding or minimizing movement of the device laterally.

The holding wall 39 can also be substantially elastic so as to rest elastically on the tab in order to hold it, while also allowing the dispensing device to easily move in order to change from the intermediate position to the position of use.

The packaging assembly can also include a cap 60 for protecting the dispensing device 20. The cap 60 can grip upon the fixing member 30, for example on the peripheral rim 38.

To assemble the packaging and dispensing assembly according to the invention, the dispensing device 20 is first mounted on the fixing member 30 in the intermediate position illustrated in FIGS. 6 and 8. The cap 60 is also assembled on the fixing member, by gripping on the peripheral wall 38. These three pieces thus assembled are then fixed on the containers which have been filled with product beforehand, via the fixing member. Thus, even if two pieces are used to implement the dispensing device, only one assembly step is necessary on the container filling lines.

Moreover, this assembly step does not require very great accuracy since the holding walls 39 provided on the fixing member 30 make it possible to properly position the dispensing device 20 relative to the passages 35 of the fixing member. The dispensing device 20 is thus easily positioned with respect to the actuation rods 11 at the time of attachment of the dispensing device 20 onto the fixing member 30.

The assembly thus assembled is then preferably sold while the dispensing device is in the intermediate position. It is at the first use of the device that the user, by pressing the actuation surface 22 of the dispensing device 20, moves the dispensing device into the use position. The dispensing device then moves in a translational movement, parallel to the longitudinal axis of the actuation rods. As the dispensing device 20 is already correctly positioned relative to the actuation rods, it will easily place itself in the use position in which the two actuation rods 11 can be moved in the same manner. The two products can then be dispensed in the same proportions at each actuation in the preferred example.

If so desired, the user can easily remove the dispensing device 20 from the packaging and dispensing assembly, between two uses, in order for example to clean it. He/she will only need, by taking the containers 10 in one hand, to grip the device 20 and move it away from the containers and the fixing member 30 in a movement along the axis of the actuation rods. The user can then rinse the dispensing device 20 under water, for example, in order to clean the ducts. He/she can then without great difficulty replace the dispensing device on the fixing member by placing it correctly with respect to the actuation rods without risking or with a reduced risk of actuating the actuation rods unintentionally. He/she can for example place the dispensing device 20 in its intermediate position by attaching the tabs by their lower notches 43 on the spindles 36 so that they do not risk actuating the actuation rods unintentionally during mounting.

In the example just described, two containers are provided, but the dispensing device 20 can also be used on a single container.

Obviously, numerous modifications and variations of the present invention are possible in light of the above teachings. It is therefore to be understood that within the scope of the appended claims, the invention may be practiced otherwise than as specifically described here.

What is claimed as new and desired to be secured by Letters Patent of the United States is:

1. An assembly for packaging and dispensing a product comprising:

at least one container containing a product, the container including a dispensing member comprising an actuation rod;

a dispensing device including at least one dispensing aperture, wherein at least part of the dispensing device is movable with respect to the container in order to actuate the dispensing member and allow output of the product through the at least one dispensing aperture;

a mounting arrangement for mounting the dispensing device with respect to the container such that the dispensing device is positionable on the container in at least two different positions including:

(a) a use position in which the dispensing device is selectively actuatable to make the actuation rod rock about a rocking axis in order to dispense the product, and in which the dispensing device cannot move the actuation rod along its longitudinal axis, such that in the use position the dispensing device selectively moves the actuation rod between a non-dispensing position in which the product does not flow from the container and a dispensing position in which the product flows from the container, and wherein the dispensing position is offset from the non-dispensing position about the rocking axis; and (b) an intermediate position in which the dispensing device is mounted to the container and in which the dispensing device is held in a position in which it is not in fluidic communication with the actuation rod;

wherein the mounting arrangement includes a spindle and an opening within which the spindle is received, and wherein rocking movement of the dispensing device about the spindle causes dispensing of the product in the use position and further wherein as the dispensing device is moved from the intermediate position to the use position the spindle is moved from a first position to a second position along the opening; and wherein in said intermediate position the mounting arrangement holds the inlet aligned with and spaced from the actuation rod.

2. An assembly according to claim 1, wherein the dispensing device is movable from the intermediate position to the use position with a movement parallel to the longitudinal axis of the actuation rod.

3. An assembly for packaging and dispensing a product comprising:

at least one container containing a product, the container including a dispensing member comprising an actuation rod;

a dispensing device including at least one dispensing aperture, wherein at least part of the dispensing device is movable with respect to the container in order to actuate the dispensing member and allow output of the product through the at least one dispensing aperture;

wherein the dispensing device is positionable on the container in at least two different positions including:

a) a use position in which the dispensing device is capable of making the actuation rod rock about a rocking axis in order to dispense the product and in which it cannot move the actuation rod along its longitudinal axis; and (b) an intermediate position in which the dispensing device is not in fluidic communication with the actuation rod;

wherein the dispensing device comprises at least one tab that cooperates with at least one spindle, with the tab pivotable about the spindle to allow rocking of the dispensing device in the use position.

4. An assembly according to claim 3, wherein the device comprises two tabs that cooperate respectively with two spindles, wherein the two tabs and the two spindles are respectively aligned along a line parallel to the rocking axis of the dispensing device.

5. An assembly according to claim 4, wherein each tab comprises an opening that opens out at its lower end.

6. An assembly according to claim 5, wherein the opening in each tab comprises a narrow portion so as to form first and second notches at two different heights, wherein each first notch receives a corresponding spindle in the use position and each second notch receives a corresponding spindle in the intermediate position.

7. An assembly according to claim 6, wherein each of the notches includes a concave shape.

8. An assembly according to claim 6, wherein the opening in each tab widens out towards a lower end of the tab.

9. An assembly according to claim 6, wherein each tab comprises at least one protuberance capable of coming into contact with a holding portion in the intermediate position so as to hold the dispensing device laterally.

10. An assembly according to claim 9, wherein the holding portion rests elastically on the protuberance in the intermediate position.

11. An assembly according to claim 1, wherein the dispensing device is mounted on the container via a fixing member.

12. An assembly according to claim 11, wherein the fixing member comprises a mounting skirt which latches onto the container.

13. An assembly according to claim 1, wherein the assembly comprises two containers.

14. An assembly for packaging and dispensing a product comprising:

at least one container containing a product, the container including a dispensing member comprising an actuation rod;

a dispensing device including at least one dispensing aperture, wherein at least part of the dispensing device is movable with respect to the container in order to actuate the dispensing member and allow output of the product through the at least one dispensing aperture;

a mounting arrangement for mounting the dispensing device with respect to the container such that the dispensing device is positionable on the container in at least two different positions including:

(a) a use position in which the dispensing device is selectively actuatable to make the actuation rod rock about a rocking axis in order to dispense the product, and in which the dispensing device cannot move the actuation rod along its longitudinal axis, such that in the use position the dispensing device selectively moves the actuation rod between a non-dispensing position in which the product does not flow from the container and a dispensing position in which the product flows from the container, and wherein the dispensing position is offset from the non-dispensing position about the rocking axis; and (b) an intermediate position in which the dispensing device is mounted to the container and in which the dispensing device is held in a position in which it is not in fluidic communication with the actuation rod;

wherein the assembly comprises two containers; and wherein the dispensing device includes two dispensing apertures and is arranged to separately channel the products from the two containers to two dispensing apertures.

15. An assembly according to claim 14, wherein the dispensing device comprises two distinct channels for conveying the product coming from each container to each dispensing aperture.

16. An assembly according to claim 13, wherein the dispensing device is arranged to allow mixing of the products from the two containers before reaching the dispensing aperture.

17. An assembly according to claim 1, further comprising a cap which protects the dispensing device.

18. An assembly according to claim 1, wherein the at least one container is pressurized.

19. An assembly according to claim 18, wherein the dispensing member includes a valve.

20. An assembly according to claim 1, wherein the container contains a cosmetic product.

21. An assembly according to claim 1, wherein the at least one container contains a hair coloring product.

22. An assembly according to claim 13, wherein one of the containers contains a hair coloring product and the other container contains an oxidizing product.

23. An assembly according to claim 1, wherein the dispensing device is arranged to prevent rocking movement in said intermediate position.

24. An assembly for packaging and dispensing a product comprising:

at least one container containing a product, the container including a dispensing member comprising an actuation rod;

a dispensing device including at least one dispensing aperture, wherein at least part of the dispensing device is movable with respect to the container in order to actuate the dispensing member and allow output of the product through the at least one dispensing aperture;

wherein the dispensing device is positionable on the container in at least two different positions including:

(a) a use position in which the dispensing device is capable of making the actuation rod rock about a rocking axis in order to dispense the product and in which it cannot move the actuation rod along its longitudinal axis; and (b) an intermediate position in which the dispensing device is not in fluidic communication with the actuation rod;

the assembly further including:

a tab having first and second notches; and a spindle, wherein said spindle is located in said first notch in said use position, and wherein said spindle is located in said second notch in said intermediate position.

25. An assembly according to claim 24, wherein the assembly comprises two containers, each including an actuation rod.

26. An assembly according to claim 25, further including a fixing member mounted upon said two containers, wherein said fixing member is fixed with respect to said two containers, and wherein at least part of said dispensing device is movable relative to said fixing member.

27. An assembly according to claim 26, wherein said tab is provided on said dispensing device and said spindle is provided on said fixing member.

28. An assembly according to claim 27, wherein said fixing member includes a passage, and wherein at least one of the actuation rods extends through said passage, and wherein said spindle extends into said passage.

29. An assembly according to claim 26, wherein the assembly includes two of said tabs and two of said spindles.

30. An assembly according to claim 1, further including:

a fixing member mounted upon said at least one container, said fixing member including a passage, wherein said actuation rod extends through said passage, said fixing member further including a spindle extending into said passage; and a tab provided on said dispensing device, said tab including first and second notches, wherein said spindle is positioned in said first notch in said use position, and wherein said spindle is positioned in said second notch in said intermediate position.

31. An assembly according to claim 30, wherein said tab includes at least one protrusion which interacts with said fixing member in said intermediate position to limit rocking movement of said dispensing device in said intermediate position.

32. An assembly according to claim 1, wherein the mounting arrangement is arranged such that the dispensing device is moved from the intermediate position to the use position in a direction along the longitudinal axis of the actuation rod, and further wherein the assembly is arranged to prevent actuation of the actuation rod by movement in the direction of the longitudinal axis of the auction rod to avoid inadvertent actuation during movement of the dispensing device from the intermediate position to the use position.

33. An assembly according to claim 1, wherein said spindle is provided on a fixing member mounted on the at least one container, and the opening is provided on the dispensing device.

34. An assembly according to claim 1, wherein the dispensing device includes a channel providing communication between said actuation rod and said aperture, wherein in said use position said channel is in sealing engagement with said actuation rod, and wherein in said intermediate position said channel is not in sealing engagement with said actuation rod, wherein said channel includes an inlet which receives the actuation rod in the use position, and wherein in the intermediate position the mounting arrangement holds the inlet at a position in which it is not fitted on the actuation rod.

35. An assembly according to claim 34, wherein in said intermediate position the mounting arrangement holds the inlet aligned with and spaced from the actuation rod.

* * * * *

UNITED STATES PATENT AND TRADEMARK OFFICE

CERTIFICATE OF CORRECTION

PATENT NO. : 7,748,568 B2
APPLICATION NO. : 11/509581
DATED : July 6, 2010
INVENTOR(S) : Pierre-Andre Lasserre et al.

It is certified that error appears in the above-identified patent and that said Letters Patent is hereby corrected as shown below:

Column 8, lines 8-11, delete "; and wherein in said intermediate position the mounting arrangement holds the inlet aligned with and spaced from the actuation rod".

Signed and Sealed this

Twenty-first Day of September, 2010

David J. Kappos

David J. Kappos
*Director of the United States Patent and Trademark Office*